US008490350B1

(12) United States Patent
Greely et al.

(10) Patent No.: US 8,490,350 B1
(45) Date of Patent: Jul. 23, 2013

(54) EXTERIOR WINDOW AND DOOR TRIM

(76) Inventors: Troy Anthony Greely, Bloomington, MN (US); Gary Michael Jeans, Bloomington, MN (US)

( * ) Notice: Subject to any disclaimer, the term of this patent is extended or adjusted under 35 U.S.C. 154(b) by 48 days.

(21) Appl. No.: 12/928,318

(22) Filed: Dec. 9, 2010

Related U.S. Application Data

(60) Provisional application No. 61/267,961, filed on Dec. 9, 2009.

(51) Int. Cl.
*E06B 1/04* (2006.01)

(52) U.S. Cl.
USPC ..... 52/213; 52/211; 52/287.1; 52/717.01; 52/718.04

(58) Field of Classification Search
USPC ..... 52/204.1, 211, 213, 215, 287.1, 656.1, 52/656.2, 717.01, 718.04
See application file for complete search history.

(56) References Cited

U.S. PATENT DOCUMENTS

| | | | | | |
|---|---|---|---|---|---|
| 3,975,875 | A * | 8/1976 | Goss, Jr. | 52/204.53 |
| 4,485,600 | A * | 12/1984 | Olson | 52/62 |
| 5,222,343 | A * | 6/1993 | Anderson | 52/718.04 |
| 5,243,800 | A * | 9/1993 | Olbrich | 52/287.1 |
| 5,339,507 | A | 8/1994 | Cox | |
| 5,410,846 | A | 5/1995 | Frambach | |
| 5,551,201 | A * | 9/1996 | Anderson | 52/717.05 |
| 5,579,617 | A * | 12/1996 | Schiedegger et al. | 52/288.1 |
| 6,050,036 | A * | 4/2000 | Frey | 52/204.5 |
| 6,050,037 | A * | 4/2000 | Gifford | 52/211 |
| 6,305,130 | B1 * | 10/2001 | Ackerman, Jr. | 52/58 |
| 6,421,964 | B1 * | 7/2002 | Schiedegger et al. | 52/94 |
| 6,427,398 | B1 | 8/2002 | Levine et al. | |
| 6,470,639 | B1 | 10/2002 | Horn et al. | |
| 6,550,210 | B1 * | 4/2003 | Levine et al. | 52/656.5 |
| 6,698,154 | B2 * | 3/2004 | Vance | 52/716.6 |
| 6,804,916 | B2 | 10/2004 | Myers | |
| 6,820,381 | B1 | 11/2004 | Ballough | |
| 6,932,303 | B2 * | 8/2005 | Snyder | 248/58 |
| 6,966,158 | B1 | 11/2005 | Christensen | |
| 7,080,490 | B2 | 7/2006 | Horn et al. | |
| 7,162,840 | B1 | 1/2007 | Thomas | |
| 7,237,365 | B1 | 7/2007 | Phandanovong | |
| 7,632,103 | B2 * | 12/2009 | Williams et al. | 434/425 |
| 7,743,564 | B2 * | 6/2010 | Schiedegger et al. | 52/211 |
| 2002/0112423 | A1 * | 8/2002 | Schiedegger et al. | 52/211 |

* cited by examiner

*Primary Examiner* — Basil Katcheves
*Assistant Examiner* — Joshua Ihezie
(74) *Attorney, Agent, or Firm* — Richard John Bartz

(57) ABSTRACT

A trim for a building having framework surrounding an opening for a window assembly or a door has a member fastened to the framework having a side pocket for accommodating a portion of siding secured to the framework. A cover releasably mounted on the member enclosed fasteners attaching the member to the framework.

22 Claims, 15 Drawing Sheets

EXTERIOR WINDOW AND DOOR TRIM

CROSS REFERENCE TO RELATED APPLICATION

This application claims the benefit of U.S. Provisional Application Ser. No. 61/267,961 field Dec. 9, 2009.

FIELD OF THE INVENTION

The present invention relates to systems, articles and methods for removing components of buildings for replacement with similar components. More specifically, the present invention relates to construction, removal and replacement of framed windows and doors through the use of an exterior trim to facilitate easy installation and removal of the windows and doors.

Single family houses and multifamily buildings are frequently constructed with framed windows and doors securely mounted to a supporting structure. In the current economic market it is often desirable to remodel existing buildings and homes as a cost effective alternative to building or buying new homes. One of the most popular remodeling goals is to replace old style, energy inefficient windows with current style, energy efficient multipane windows. The removal of the old windows and door however, normally requires major defacement of the building exterior which, in turn, requires major restoration after replacement with new windows and doors.

This is because windows and doors, are relatively permanently attached to the building's structure with nails and also to any covering material, such as siding of the building construction. No provision is generally made for replacement of these components with newer components particularly in stucco and masonry exterior construction where fasteners are normally covered by an exterior finish. The normal practice for replacing windows is to break or cut away the covering material, remove the window and frame by prying and breaking it out, replace the removed window and frame with a new window and frame, and then patch the exterior and interior surfaces. Patching old surfaces such as weathered stucco and brick is rarely done without leaving highly undesirable visible changes in texture or color. Furthermore, for newer construction homes, any siding used on the exterior of the home is at least partially removed and destroyed in order to pull the window frame and window out.

In another example, replacement window frames can be installed over an existing window frame of a building, either during renovation of the structure or during replacement of the structure's windows. In this example, the existing window is first removed, and the remaining window frame is prepared for installation of the replacement window. The existing frame is usually constructed from wood or from a metal, such as aluminum. Alternatively, the existing window and its frame may be removed, thereby leaving a rough opening in the building structure. This rough opening is then prepared to accept the replacement window frame. In this example as well, any covering material such as siding or other material must be at least partially destroyed in order to reach the frame and window.

In addition to the aesthetic shortcomings of the current practice, the time required to accomplish the removal and restoration is normally hours at best, sometimes days. The work may also require several craftsmen, such as a carpenter for the removal and replacement, a plasterer or mason, and a painter, for the restoration. Furthermore, the scheduling difficulties for the several craftsmen may require several days to the complete task. The more time and effort required, the higher the cost of window or door replacement. When several windows and/or doors are to be replaced, the client must balance costs against budget, frequently choosing to replace less than the total number of windows and/or doors desired in order to remain within budgetary constraints.

The prior art does not disclose alternative tools or methods for minimizing the destruction of the surrounding surfaces, expediting the procedure or minimizing costs when remodeling involves the removal and replacement of windows and/or doors.

SUMMARY OF THE INVENTION

The present invention provides efficient systems, articles and methods for the removal of windows and/or doors which eliminates the collateral damage to exterior and interior surfaces of the building adjacent to the window or door. The systems, articles, and methods described herein efficiently and quickly complete removal, leaving the basic supporting frame structure undamaged and ready to receive the replacement component in the form of a window or door. The replacement component may then be installed and the task is complete. The entire process is typically completed in a minimum of time and labor. The speed with which the removal and replacement is achieved provides corresponding reduced cost to complete the remodeling process.

The present invention includes an exterior trim that is suitable for trimming windows, doors and other openings. The exterior trim includes a plurality of exterior trim members that enclose an opening in a wall of a building construction. Each trim member has an elongated planar portion defining a back flange with two spaced apart edges and first and second flanges extending from the two edges, respectively. The first flange extends from a wall-facing side in an opposite direction from the first edge of the exterior trim member while the second flange extends laterally from the second edge to form a C-channel for receiving siding or sheathing from the building construction. In addition, the first flange includes a connector disposed at an end remote from the wall-facing side. The planar portion of the exterior window trim further includes a plurality of apertures disposed therein that is designed to receive fastening devices that fasten the exterior trim member to the wall. A snap cover is attached to the exterior trim member to protect the exterior trim from damage from harsh environmental elements.

The exterior trim is positioned between a window opening in the wall of the building construction and siding or other exterior covering material. The exterior trim is adapted to accommodate a window assembly disposed in the wall of the building construction on one side exterior trim and siding on the opposite side of the exterior trim. The exterior trim serves to eliminate direct connection of the window assembly to the siding as is normally done in conventional building structures. Since the window assembly is not directly attached or connected to the siding, the siding need not be removed in order to gain access to the window assembly. The invention also is applicable to door frames in which case a lower exterior trim member will not be employed.

DESCRIPTION OF THE DRAWING

As shown in FIG. 1, a frame building 10 has an upright wall with siding 11, such as vinyl, metal and composition weatherproof facing, attached to building framework 12. Framework 12 surrounds a rectangular opening 15 accommodating a window assembly 13. Window assembly 13 includes a casing 14 and one or more transparent windows 16. The casing 14 is secured to the framework 12 around opening 15. When new siding 11 or repair siding is attached to framework 12, a replacement window assembly is also added to the building. The siding around opening 15 must be removed to allow the window assembly 13 to be removed from framework 12 and replaced with a new window assembly. The removal of the old windows and doors requires major defacement of the siding and substantial restoration after replacement of new windows and doors.

An exterior trim 17 attached to framework 12 around opening is provided for easy removal and installation of window assembly 13. Trim 17 is also useable around doorways for convenient removal and installation of a door casing and door. Trim 17 has side trim members 18 and 19 and top and bottom trim members 20 and 21. Trim members 18 to 21 are identical in structure and function. The following description and FIGS. 2 to 8 are directed to trim member 19.

FIG. 2 shows a partial perspective view of an exterior trim member 19 that is used for easy installation and removal of window assembly 13. A plurality of exterior trim members 18 to 21 are used to create the exterior trim 17 of the present invention. The exterior trim 17 is fastened to an exterior wall that surrounds an opening for window assembly 13 that is disposed therein during building construction. The exterior trim 17 is located between and attached to window assembly 13 on one side of the exterior trim 17 and siding 11 on an opposite side of the exterior trim 17. The exterior trim 17 is adapted to receive and support a portion of the window assembly 13 on one side and a portion of the siding 11 on the other side. The exterior trim 17 prevents direct attachment of the window assembly 13 to siding 11. Elimination of direct attachment of the window assembly 13 to siding 11 enables removal of the window assembly 13 without destruction of siding 11 during replacement and installation.

Figure 1:
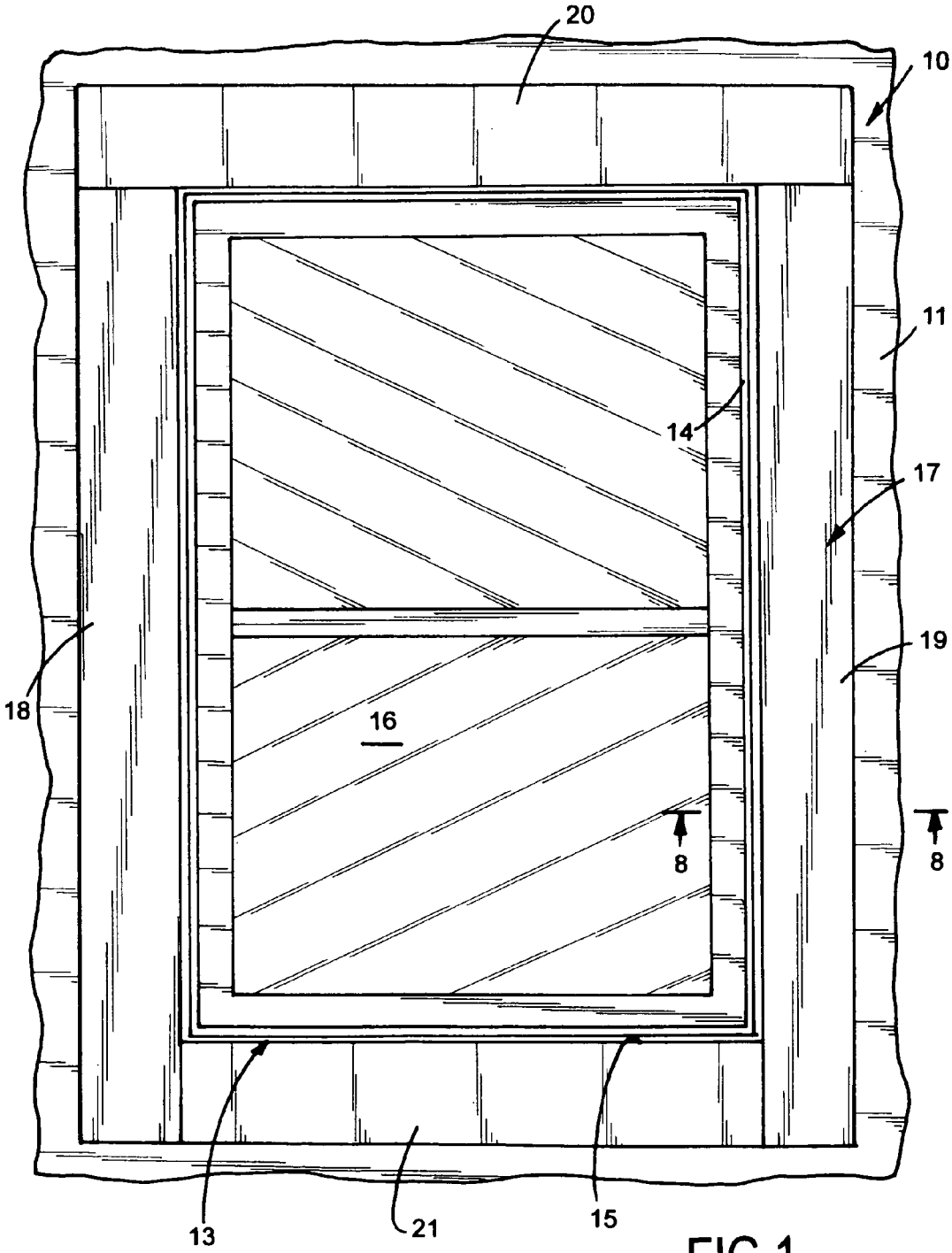
FIG. 1 is a front elevational view of a portion of a building having a window surrounded with a first embodiment of the trim of the invention.
Figure 2:
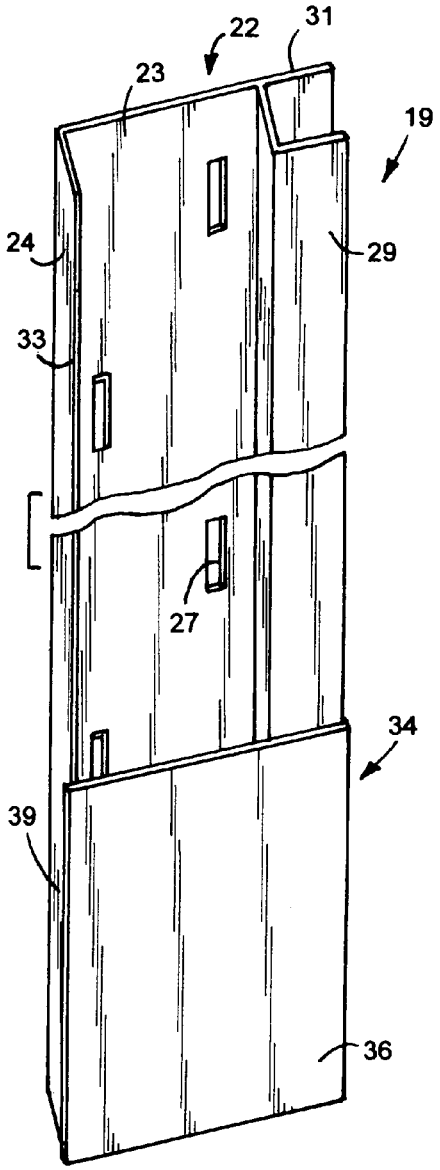
FIG. 2 is a foreshortened perspective view, partly sectioned, of the trim of FIG. 1.
Figure 3:
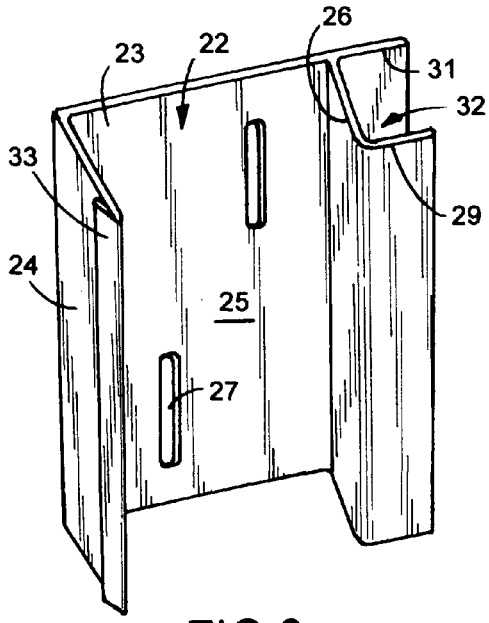
FIG. 3 is a perspective view of the primary first member of the trim.
Figure 4:
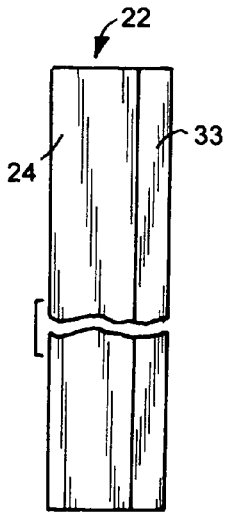
FIG. 4 is a foreshortened side elevational view of the left side of FIG. 3.
Figure 5:
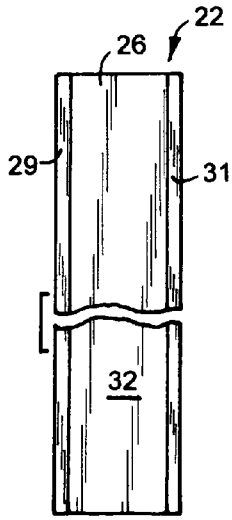
FIG. 5 is a foreshortened side elevational view of the right side of FIG. 3.
Figure 6:
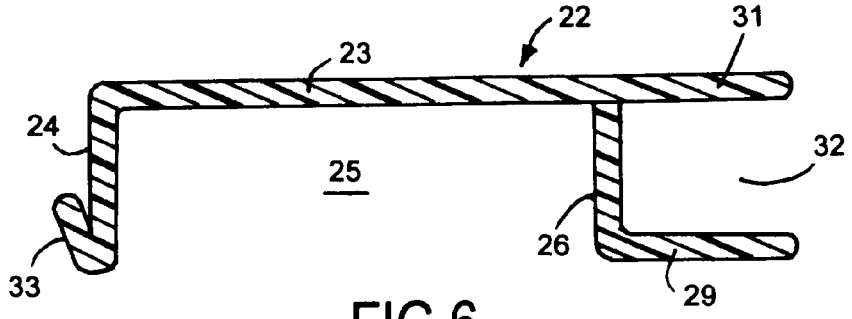
FIG. 6 is an enlarged cross sectional view of the first member of the trim.
Figure 7:
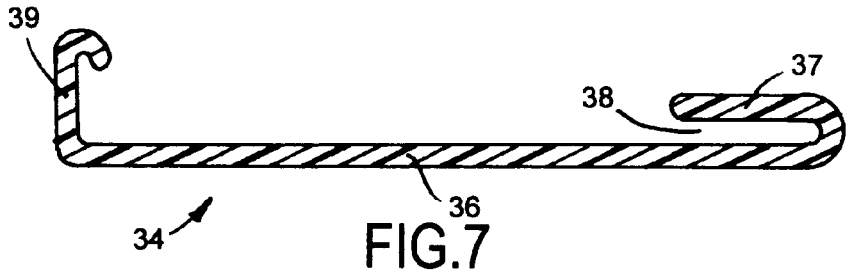
FIG. 7 is an enlarged cross sectional view of the cover of the trim.
Figure 8:
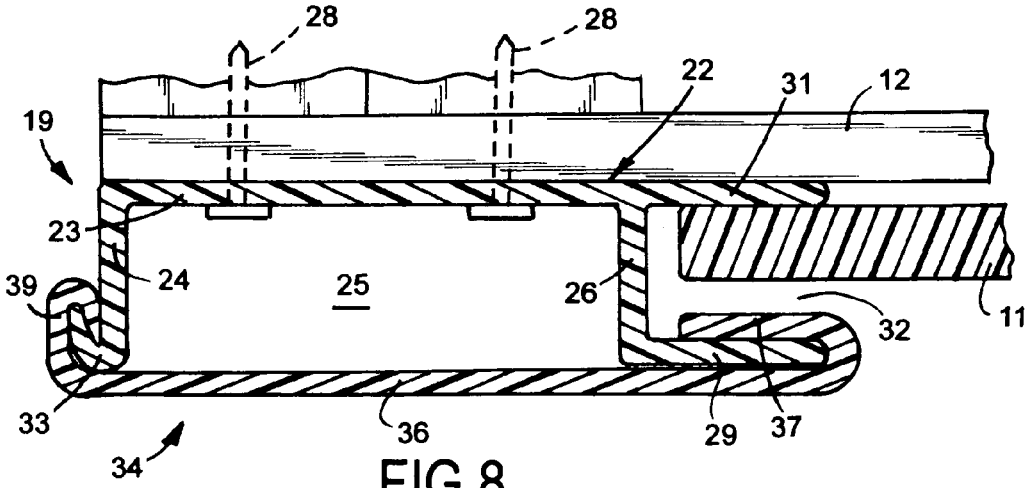
FIG. 8 is a sectional view taken along line 8-8 of FIG. 1.

Trim member 19, shown in FIGS. 2 and 8, has a base or primary first member 22 comprising a back wall 23 joined to side walls 24 and 26 forming an upright U-shaped channel 25. Back wall 23 includes rows of longitudinally spaced apertures or slots 27. Fasteners 28, shown in FIG. 8 as nails or screws, secure back wall 23 flat against framework 12 adjacent opening 15 for window assembly 13. A linear flange 29 joined to the outer end of side wall 26 is laterally spaced from a back wall portion 31 to form with side wall 26 a side pocket or C-channel 32 for accommodating an end portion of sheathing of siding 11. An inwardly turned latch lip or flange 33 is joined to the outer end of side wall 24. First member 22 is a one-piece plastic element. Other materials including metal can be used to fabricate first member 22.

The outer open front side of first member 22 is closed with a second member or cover 34 releasably mounted flange 29 and side wall 24. Cover 34 has a generally flat front wall 36. An inwardly directed flange or lip 37 joined to the inner end of wall 36 forms a groove or linear recess 38 accommodating flange 29, shown in FIG. 8, to retain cover 34 on first member 19. The outer end of wall 36 has an inverted J-shaped hook 39 cooperating with latch lip 33 to hold cover 34 on side wall 24. Latch lip 33 and hook 39 comprise a releasable connector that allows cover 34 to be mounted on and removed from first member 19 to provide an aesthetically pleasing cover that protects first member 19 and the end of siding 11 from weather elements.

Side wall 24 is a flat flange characterized as an elongated member or window-facing flange that extends from the wall-facing side and ends with a hook 33 formed integrally therewith. The window-facing side wall 24 extends along the length of the exterior trim 19. Similarly, hook 33 of the window-facing flange is disposed at an end remote from the back wall 23 and also extends along the length of the exterior trim member 19. Window-facing flange including hook 39 may also comprise a conventional channel, such as a J-channel adapted to accept a window casing or door frame. Trim 17 may be manufactured based upon different designs of side wall 24 to accommodate different designs of window casings and door frames.

Figure 9:
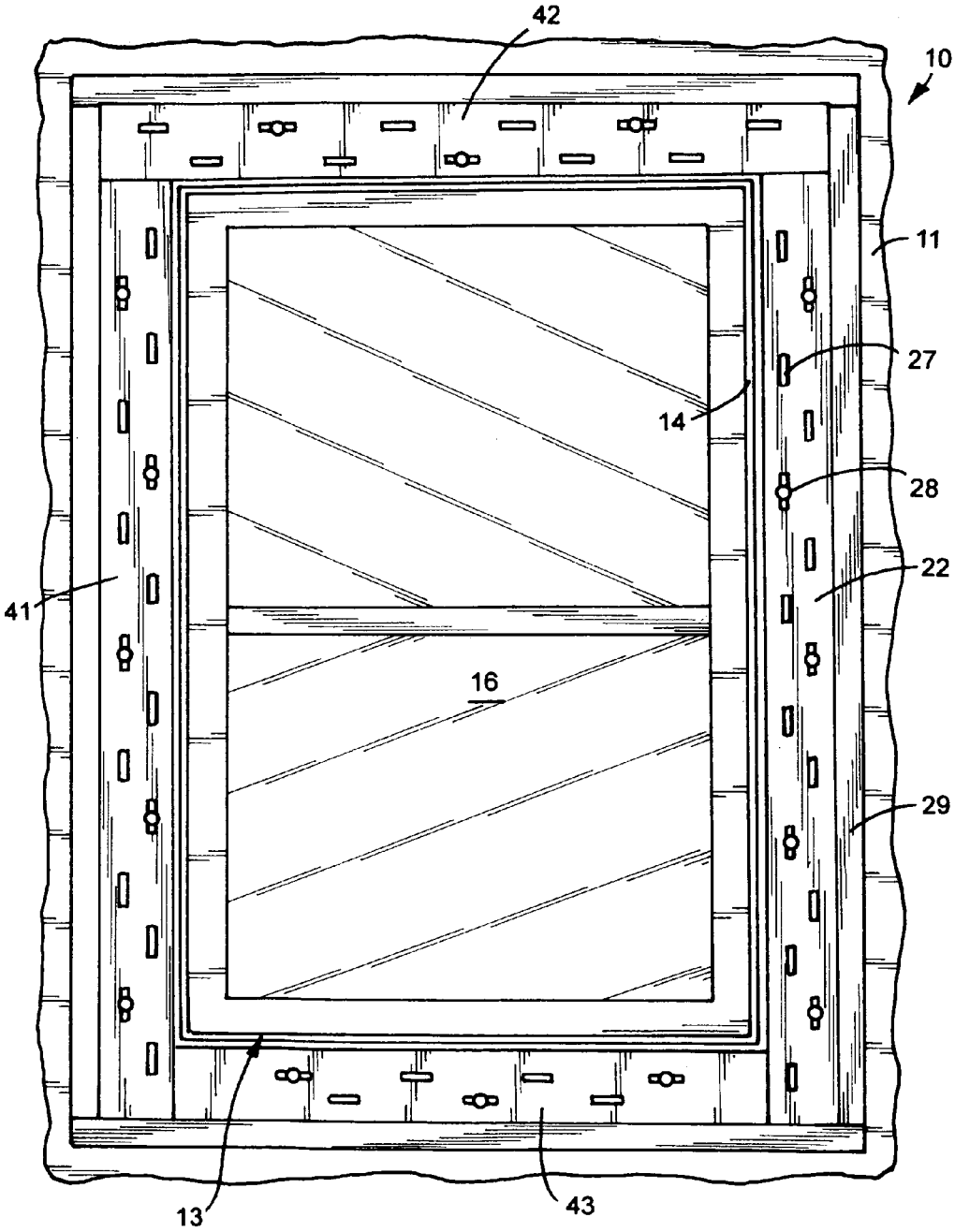
FIG. 9 is a front elevational view of a portion of a building having a window surrounded by the first member of the trim.
Figure 10:
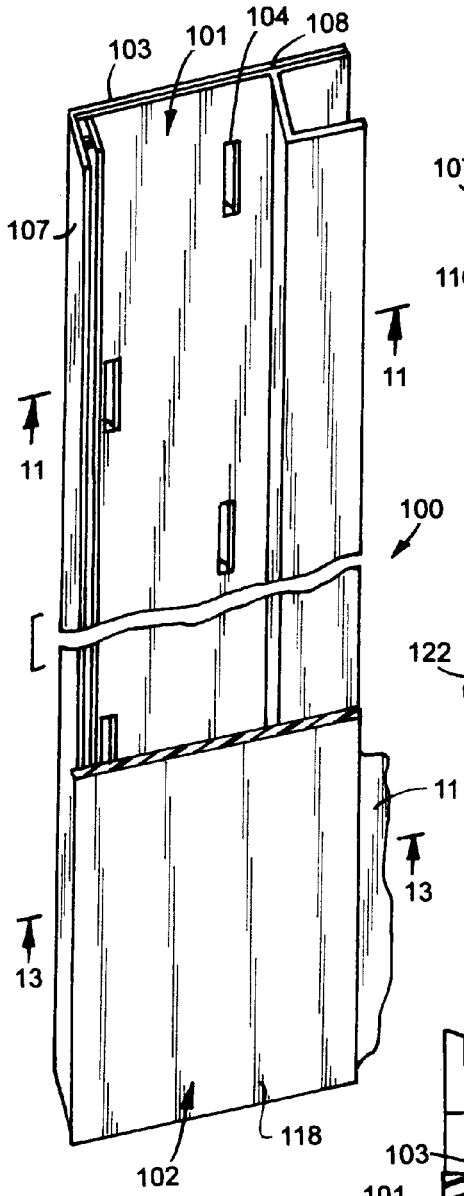
FIG. 10 is a foreshortened perspective view, partially sectioned, of a second embodiment of the trim of the invention.
Figure 11:
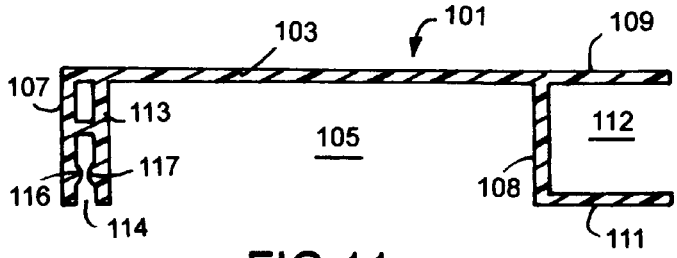
FIG. 11 is an enlarged sectional view taken along the line 11-11 of FIG. 10.
Figure 12:
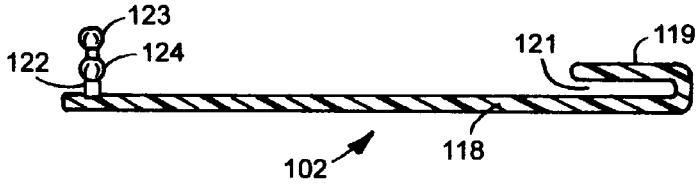
FIG. 12 is a cross sectional view of the cover of the trim of FIG. 10.

As shown in FIG. 9, the first member 22 and remaining first members 41, 42 and 43 are moved over adjacent end and side portions of siding 11 to position the end and side portions of siding in pockets 32 as shown in FIG. 8. The end and side portions of the siding are not reworked or altered during attaching first members 22 and 41-43 to framework 12 and removing the first members 22 and 41-43 from framework 12. First member 22 and remaining first members 41, 42 and 43 are attached to framework 12 proximate to the opening for window assembly 13 with fasteners 28. Fasteners 28 are driven through one or more apertures 27 to retain back wall 23 in surface engagement with framework 12. Apertures 18 can be in the shape of nailing slots, cylindrical holes, circular holes, squares or any shape that allows a fastening device to secure members 22 and 41-43 to the framework. The preferred fasteners for such an installation are corrosion-resistant nails, such as galvanized roofing nails, aluminum nails or stainless steel nails, or screws. Cover 34 is mounted on first member 19 laterally moving front wall 36 to place flange 29 in recess 38 and angularly or swinging front wall 36 toward side wall 24. Hook 38 snaps over lip 33 to releasably retain cover on first member 19. Covers similar to cover 34 are releasably retained on first members 41-43.

Figure 13:
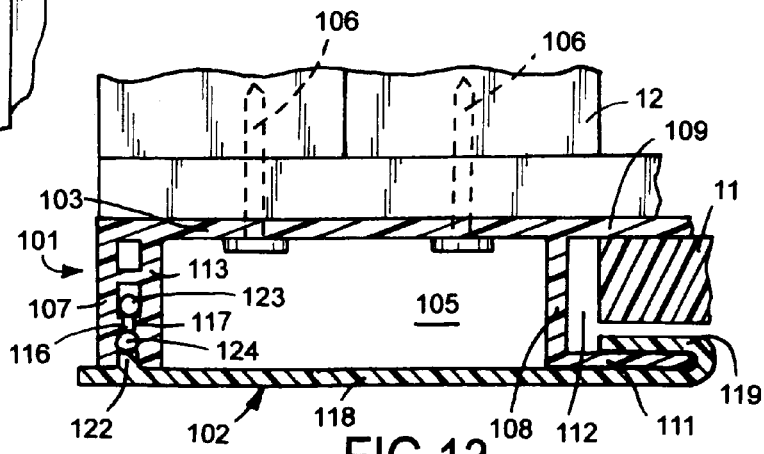
FIG. 13 is an enlarged sectional view taken along the line 13-13 of FIG. 10.
Figure 14:
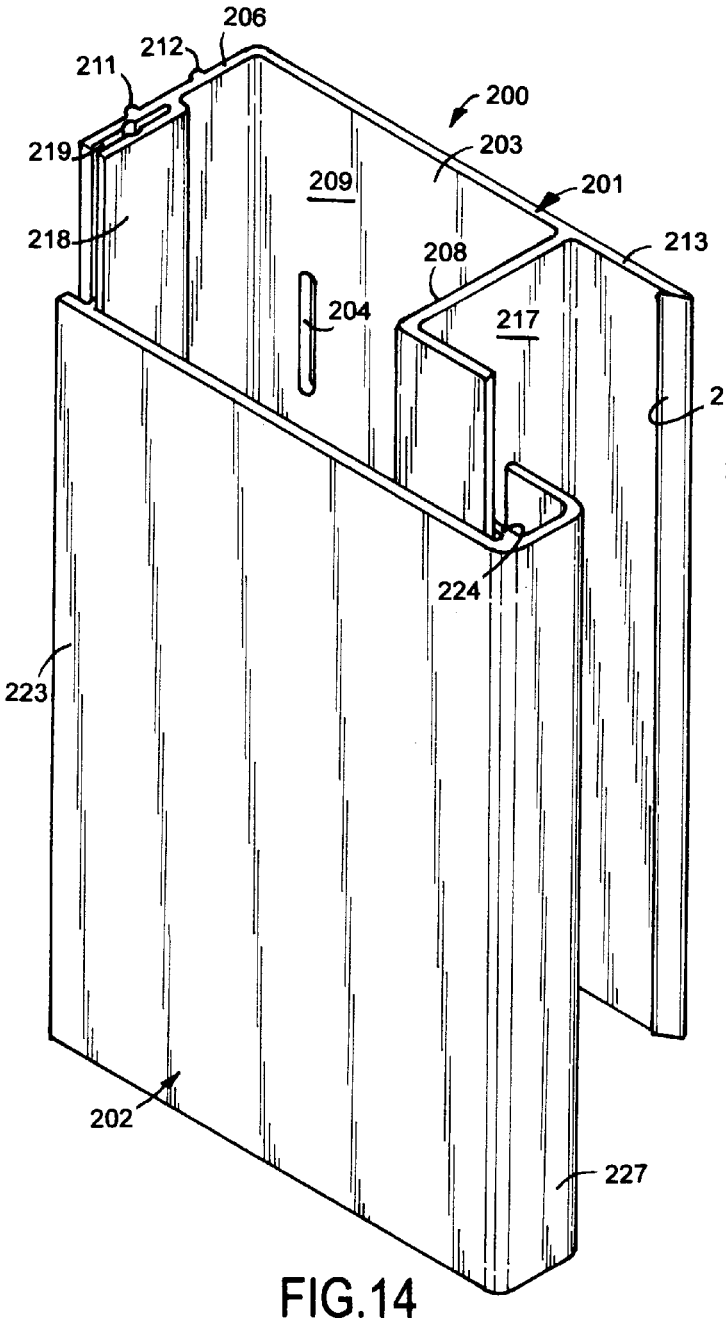
FIG. 14 is a perspective view of a third embodiment of the trim of the invention.
Figure 15:
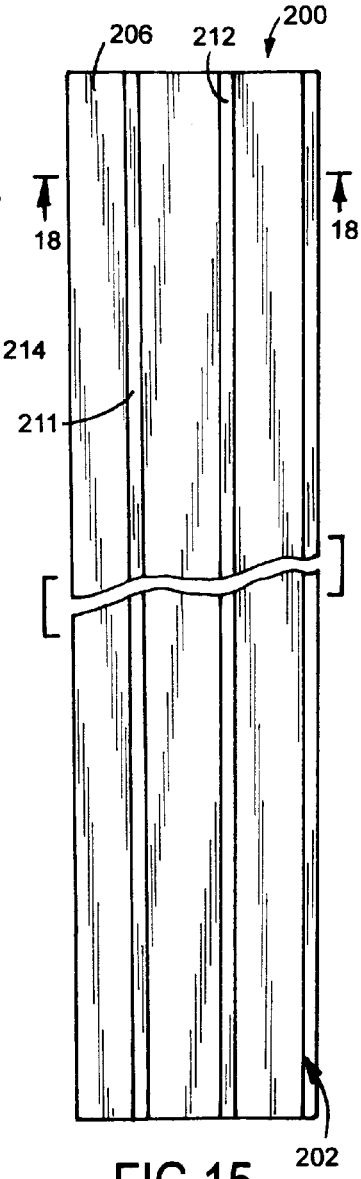
FIG. 15 is a foreshortened side elevational view of the left side of FIG. 14.
Figure 16:
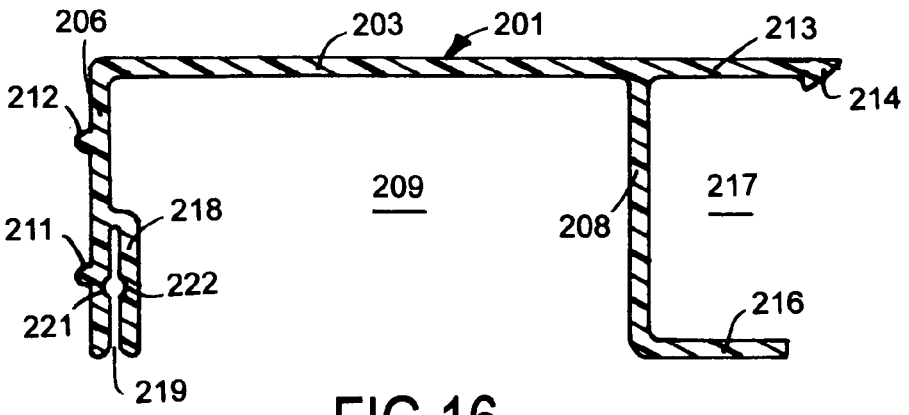
FIG. 16 is an enlarged cross sectional view of the first member of the trim of FIG. 14.
Figure 17:
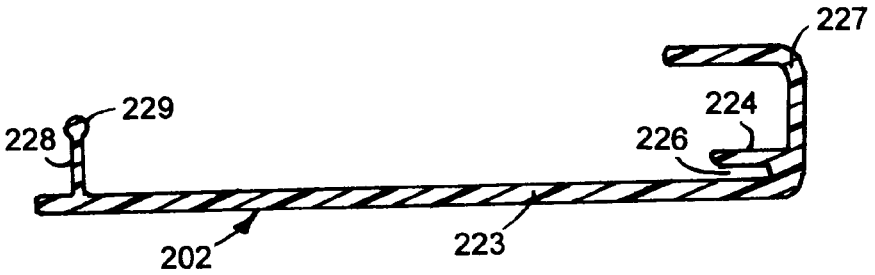
FIG. 17 is an enlarged cross sectional view of the cover of the trim of FIG. 14.

A second embodiment of the trim 100, shown in FIGS. 10 to 13, has a primary first member 101 and a cover 102 releasably connected to member 101. First member 101 has a linear flat back wall 103 with two rows of apertures or slots 104. As shown in FIG. 13, fasteners 106, such as nails or screws, retain back wall 103 in surface engagement with building framework 12 surrounding the opening for a window assembly or door frame. Side walls 107 and 108 extend forwardly from back wall 103 provide a U-shaped channel 105 between side walls 107 and 108 to allow a workperson to drive fasteners 106 into framework 12. Back wall 103 has an inwardly directed extension or wall portion 109 engageable with framework 12. An inwardly directed flange 111 joined to the outer end of side wall 108 surrounds a C-channel or lateral side pocket 112 accommodating end portions of siding 11. First member 101 includes an inside wall 113 extended outwardly from back wall 103 generally parallel to side wall 107. An elongated slot or groove 114 located between side wall 107 and wall 113 is partly closed with bosses or projections 116 and 117 for holding cover 102 on first member 101.

Cover 102 has a generally flat front wall 118 joined to a lip 119 located over an inner end portion of wall 118 to provide a groove or slot 121. As shown in FIG. 13, lip 111 located in slot 121 retains cover 102 on lip 111. The outer end position of front wall 118 has an inwardly extended rib 122 having spaced beads 123 and 124. Rib 122 is forced into groove 114 with bead 123 snapped over projections 116 and 117 to retain cover 102 in first member 101. Cover 102 can be removed from first member 101 by pulling front wall 118 away from sidewalls 107 and 113 to extract rib 122 from groove 114 and slide lip 119 off flange 111.

Figure 18:
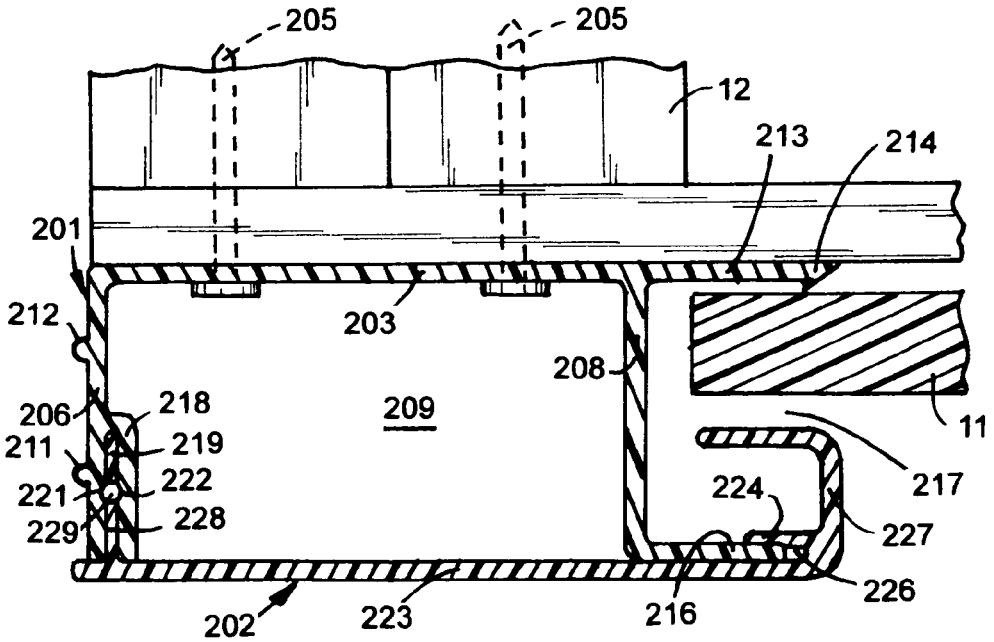
FIG. 18 is an enlarged sectional view taken along the line 18-18 of FIG. 15.
Figure 19:
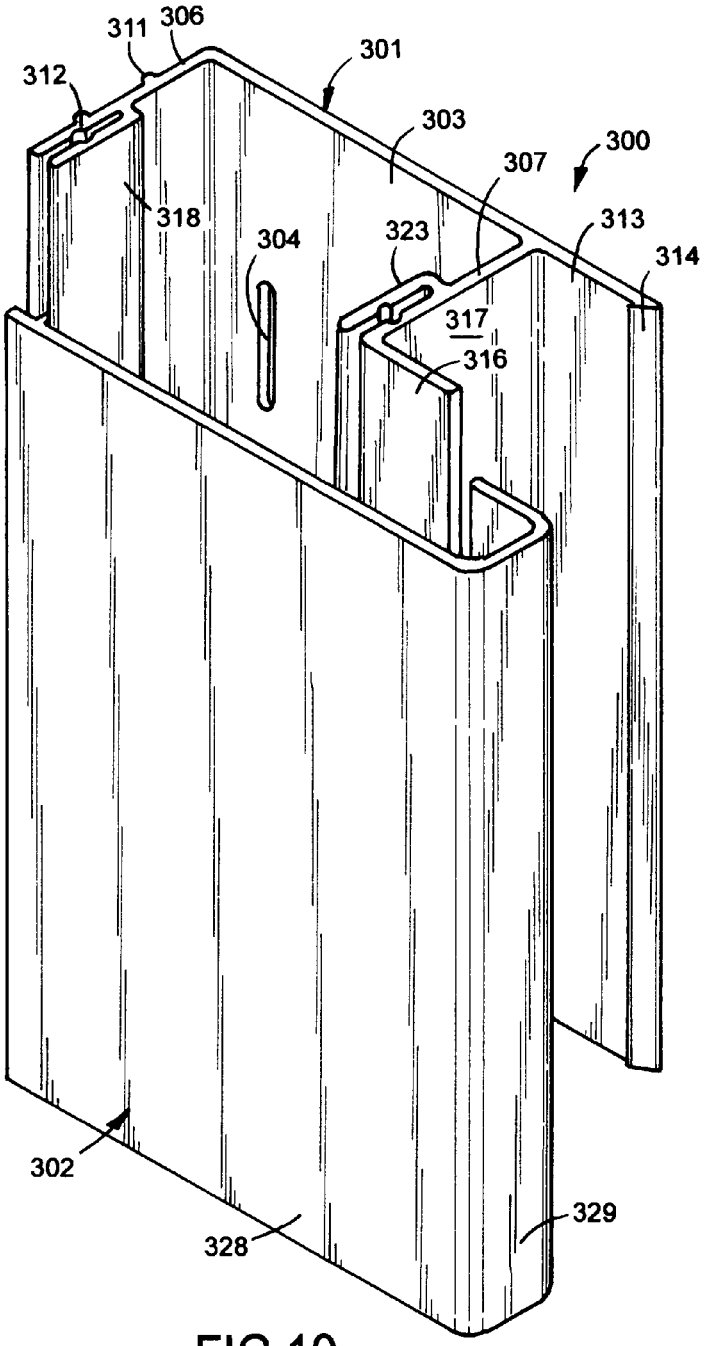
FIG. 19 is a perspective view of a fourth embodiment of the trim of the invention.
Figure 20:
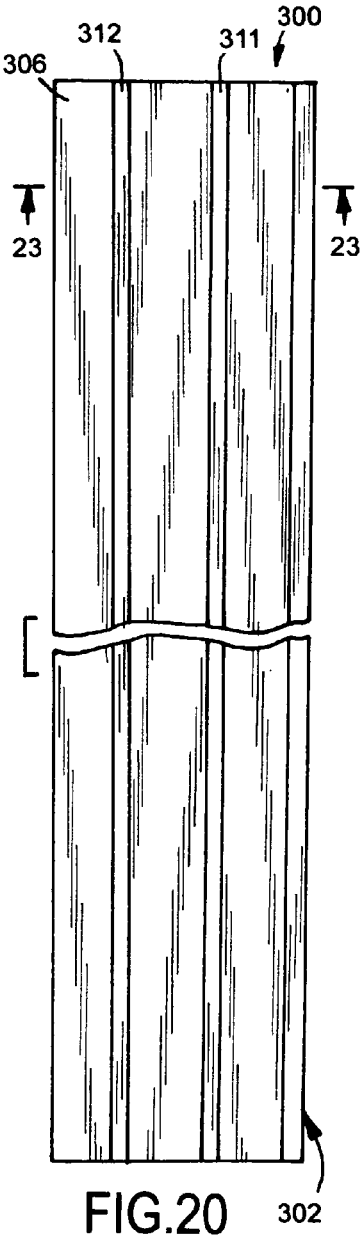
FIG. 20 is a foreshortened side elevational view of the left side of FIG. 19.
Figure 21:
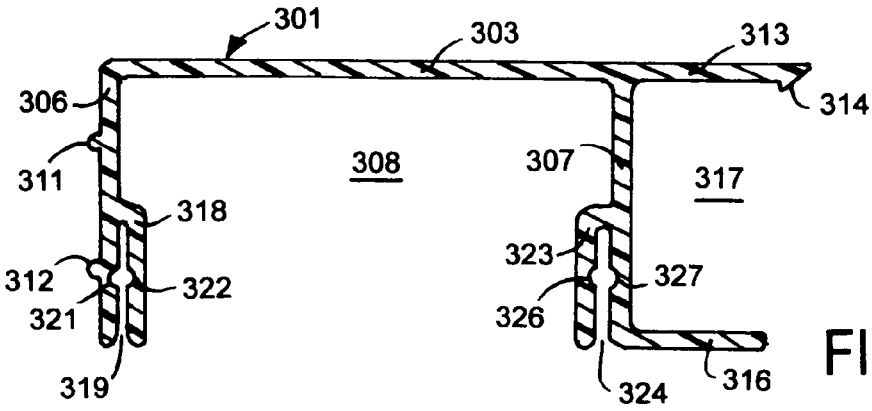
FIG. 21 is an enlarged cross sectional view of the first member of the trim of FIG. 19.
Figure 22:
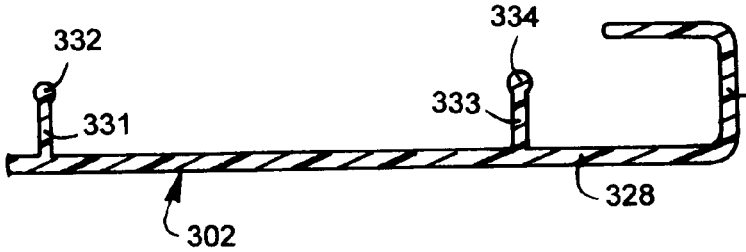
FIG. 22 is an enlarged cross sectional view of the cover of the trim of FIG. 19.

A third embodiment of the trim 200, shown in FIGS. 14 to 18, has a primary first member 201 and a cover 202 releasably connected to member 201. First member 201 comprises a generally flat back wall 203 having apertures or slots 204 accommodating fasteners 205, such as nails or screws, to retain member 201 on building framework 12 adjacent the opening for the window assembly or door frame. Side walls 206 and 208 extend forwardly from back wall 203 provide a U-shaped channel 209 between side walls 206 and 208 to allow a workperson to drive fasteners 205 into framework 12. As shown in 14, 15 and 18, side wall 206 has a pair of spaced longitudinal ribs 211 and 212 that function as spacers to separate the window casing from side wall 206. Caulking in the space between window casing and the outside of side wall 206 is used to seal the window casing with side wall 206. Ribs 211 and 212 can be spaced projections or linear segments that function as spacers separating the window casing from side wall 206. Back wall 203 has an inward extension or portion 213 having a longitudinal inside lip 214 extended into C-channel or side pocket 217. An outwardly extended flange 216 joined to side wall 208 forms with extension 213 pocket 217 for siding 11. The outer portion of side wall 206 has an inside wall 218 providing a slot or groove 219. Detent recesses 221 and 222 are located in the adjacent inside surfaces of walls 216 and 218. Cover 202 has a generally flat front wall 223 with a turned lip 224 providing a slot 226 to accommodate flange 216 of first member 201. An end wall 227 extends into pocket 217 and provide an outside face adjacent siding 11. The outer end portion of front wall 223 has a rib 228 terminating in a linear detent bead 229. As shown in FIG. 18, rib 228 and bead 229 are located in groove 219 with bead snapped into recesses 221 and 222 to releasably retain on first member 201. Cover 202 can be removed from first member 201 by pulling cover 202 away from side wall 206 to withdraw rib 228 and bead 229 from groove 219 and then sliding cover 202 off of flange 216.

Figure 23:
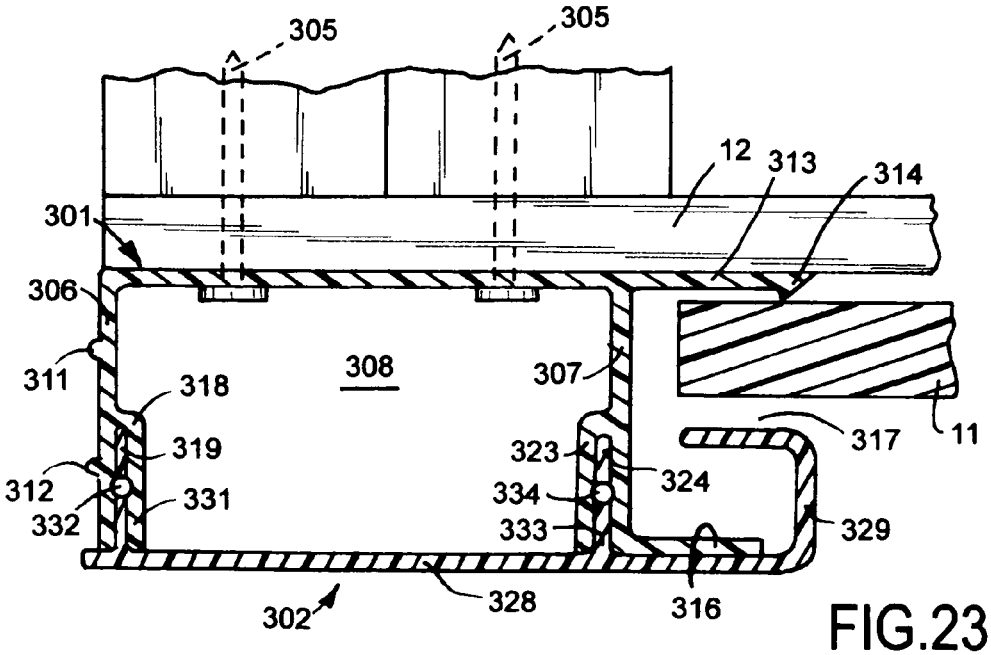
FIG. 23 is an enlarged sectional view taken along line 23-23 of FIG. 20.
Figure 24:
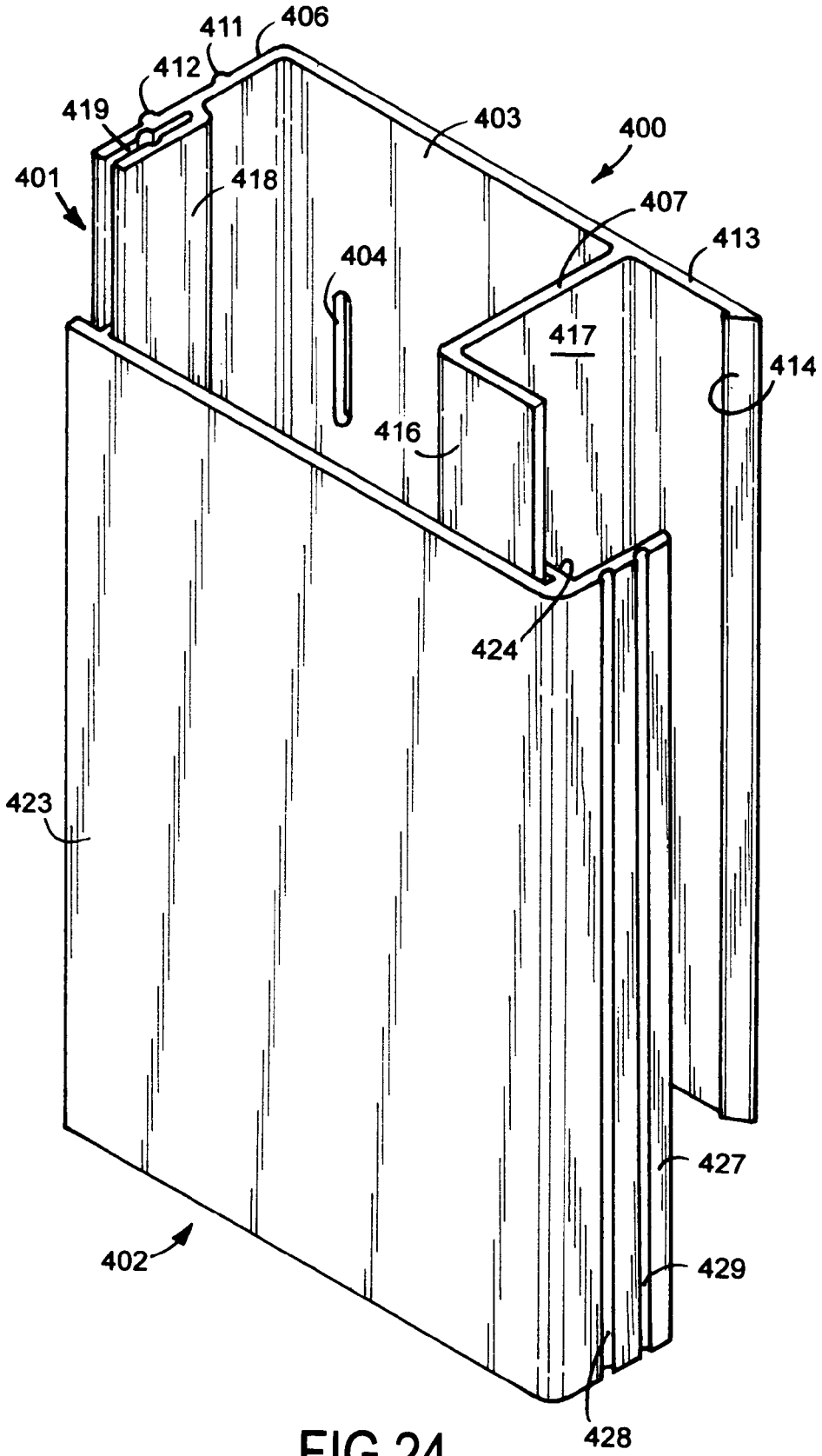
FIG. 24 is a perspective view of a fifth embodiment of the trim of the invention.
Figure 25:
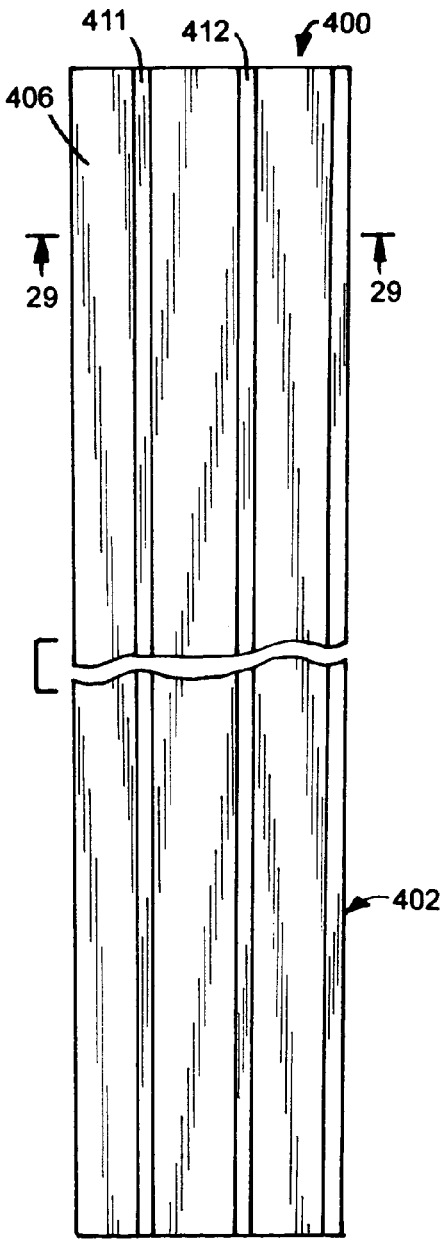
FIG. 25 is a foreshortened side elevational view of the left side of FIG. 24.
Figure 26:
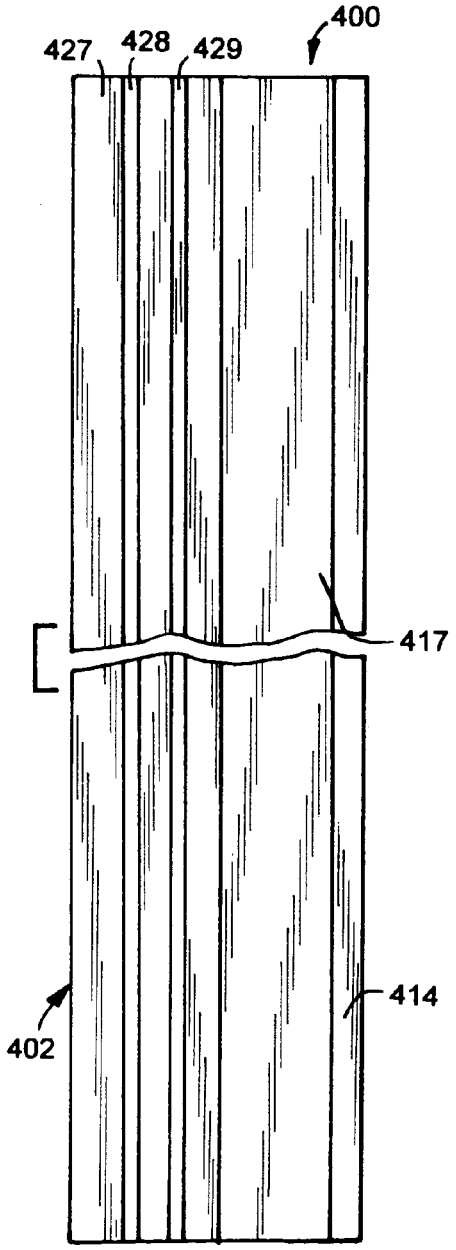
FIG. 26 is a foreshortened side elevational view of the right side of FIG. 24.
Figure 27:
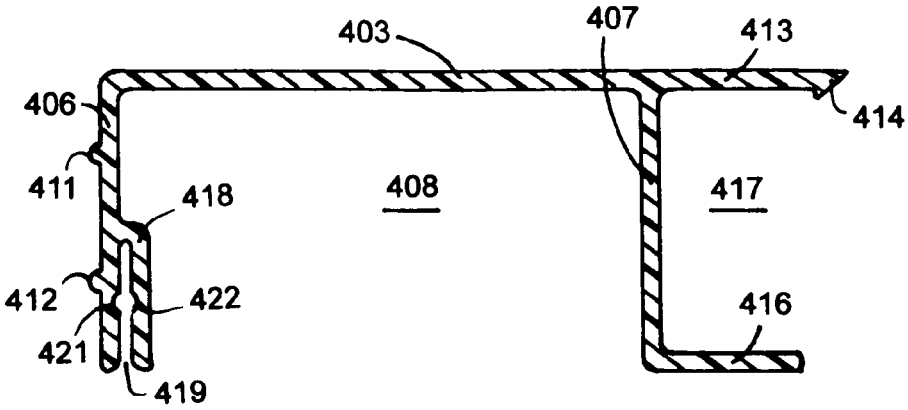
FIG. 27 is an enlarged cross sectional view of the first member of the trim of FIG. 24.
Figure 28:
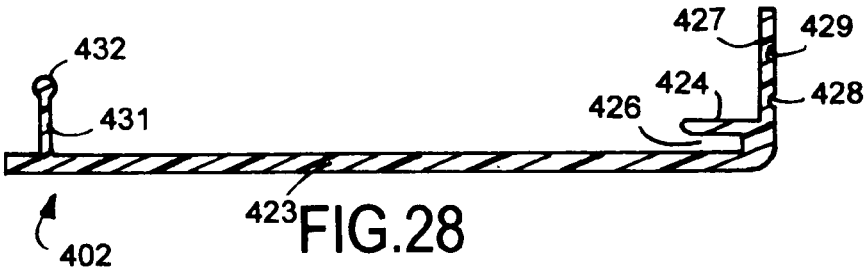
FIG. 28 is an enlarged cross sectional view of the cover of the trim of FIG. 24.
Figure 29:
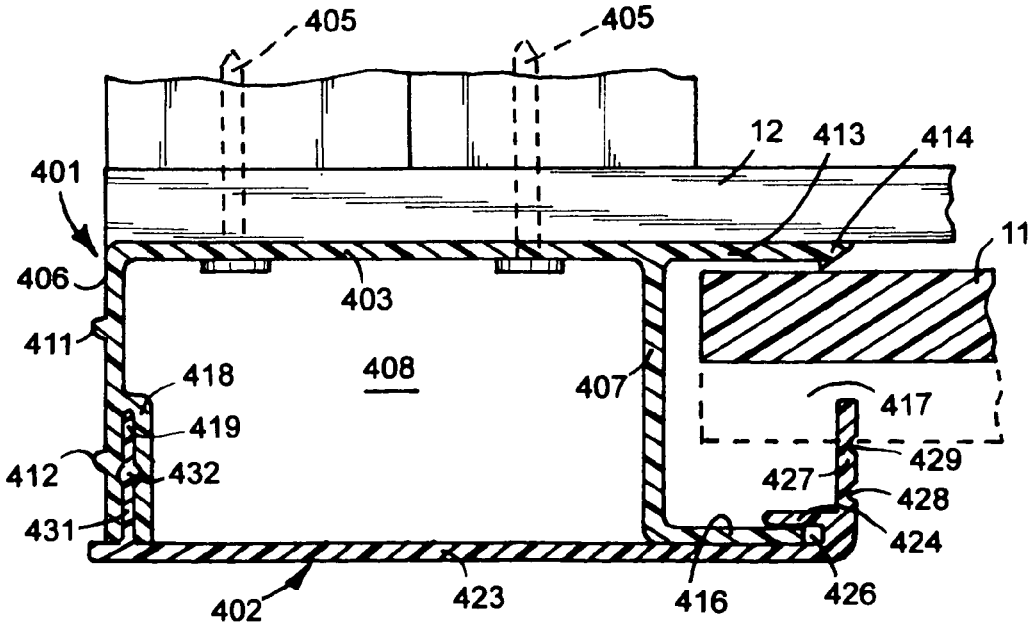
FIG. 29 is an enlarged sectional view taken along the line 29-29 of FIG. 25.

A fourth embodiment of the trim 300, shown in FIGS. 19 to 23, has a primary first member 301 and a cover 302 releasably connected to member 301. First member 301 comprises a generally flat back wall 303 having apertures or slots 304 accommodating fasteners 305, such as nails or screws, to retain member 301 on building framework 12 adjacent the opening for the window assembly or door frame. Side walls 306 and 308 extend forwardly from back wall 303 provide a U-shaped channel 309 between side walls 306 and 308 to allow a workperson to drive fasteners 305 into framework 12. As shown in 19, 20 and 23, side wall 306 has a pair of spaced longitudinal ribs 311 and 312 that function as spacers to separate the window casing from side wall 306. Caulking in the space between window casing and the outside of side wall 306 is used to seal the window casing with side wall 306. Ribs 311 and 312 can be spaced projections or linear segments that function as spacers separating the window casing from side wall 306. Back wall 303 has an inward extension or portion 313 having a longitudinal inside lip 314 extended into C-channel or side pocket 317. An outwardly extended flange 316 joined to side wall 308 forms with extension 313 side pocket 317 for accommodating siding 11. The outer portion of side wall 306 has an inside wall 318 providing a slot or groove 319. Detent recesses 321 and 322 are located in the adjacent inside surfaces of walls 316 and 318. Cover 302 has a generally flat front wall 328 with an inwardly turned end wall 329 extended into pocket 319 adjacent siding 11 and provides an outside face adjacent siding 11. Siding 11 secured to framework 12 is retained into seating contact with lip 314 to inhibit air, dust and dirt from flowing into framework 12 and building wall. The outer end portion of front wall 328 has an inwardly extended first rib 331 terminating in a linear bead 332. A second inwardly extended rib 333 terminating in a linear bead 334 is located adjacent end wall 329. As shown in FIG. 23, ribs 331 and 333 are located in grooves 319 and 324 with beads 332 and 334 snapped into detent recesses 321, 322 and 326, 327 to releasably retain cover 302 on first member 301 and closing the channel 308. Cover 302 can be removed from first member 301. Cover 302 can be removed from first member 301 by pulling cover 302 away from side walls 306 and 307 to withdraw ribs 331 and 333 from grooves 319 and 324.

A fifth embodiment of the trim 400, shown in FIGS. 24 to 29, has a primary first member 401 and a cover 402 releasably connected to member 401. First member 401 comprises a generally flat back wall 403 having apertures or slots 404 accommodating fasteners 405, such as nails or screws, to retain member 401 on building framework 12 adjacent the opening for the window assembly or door frame. Side walls 406 and 408 extend forwardly from back wall 403 provide a U-shaped channel 409 between side walls 406 and 408 to allow a workperson to drive fasteners 405 into framework 12. As shown in 24, 25 and 29, side wall 406 has a pair of spaced longitudinal ribs 411 and 412 that function as spacers to separate the window casing from side wall 406. Caulking in the space between window casing and the outside of side wall 406 is used to seal the window casing with side wall 406. Ribs 411 and 412 can be spaced projections or linear segments that function as spacers separating the window casing from side wall 406. Back wall 403 has an inward extension or portion 413 having a longitudinal inside lip 414 extended into C-channel or side pocket 417. An outwardly extended flange 416 joined to side wall 407 forms with extension 413 side pocket 417 for siding 11. Siding 11 attached to framework 12 is in sealing contact with lip 414 to inhibit the flow of air, dust and dirt into framework 12 and building wall. The outer portion of side wall 406 has an inside wall 418 providing a slot or groove 419. Detent recesses 421 and 422 are located in the adjacent inside surfaces of walls 416 and 418. Cover 402 has a generally flat front wall 423 with a turned lip 424 providing a slot 426 to accommodate flange 416 of first member 401. An end wall 427 extends into pocket 417 and provide an outside face adjacent siding 11. End wall 427 has an outside surface provided with linear longitudinal grooves 428 and 429 extended along the length of wall 427. Grooves 428 and 429 provide guidelines for cutting wall 427 to accommodate thick sheathing or siding, as shown in broken lines in FIG. 29. Grooves 428 and 429 are adjacent live linear hinges that allow a section of end wall 427 to be turned into pocket 417 when thicker siding is attached to framework 12. The outer end portion of front wall 423 has a rib 434 terminating in a linear detent bead 432. As shown in FIG. 18, rib 431 and bead 432 are located in groove 419 with bead snapped into recesses 421 and 422 to releasably retain on first member 401. Cover 402 can be removed from first member 401 by pulling cover 402 away from side wall 406 to withdraw rib 431 and bead 432 from groove 419 and then sliding cover 402 off of flange 416.

Figure 30:
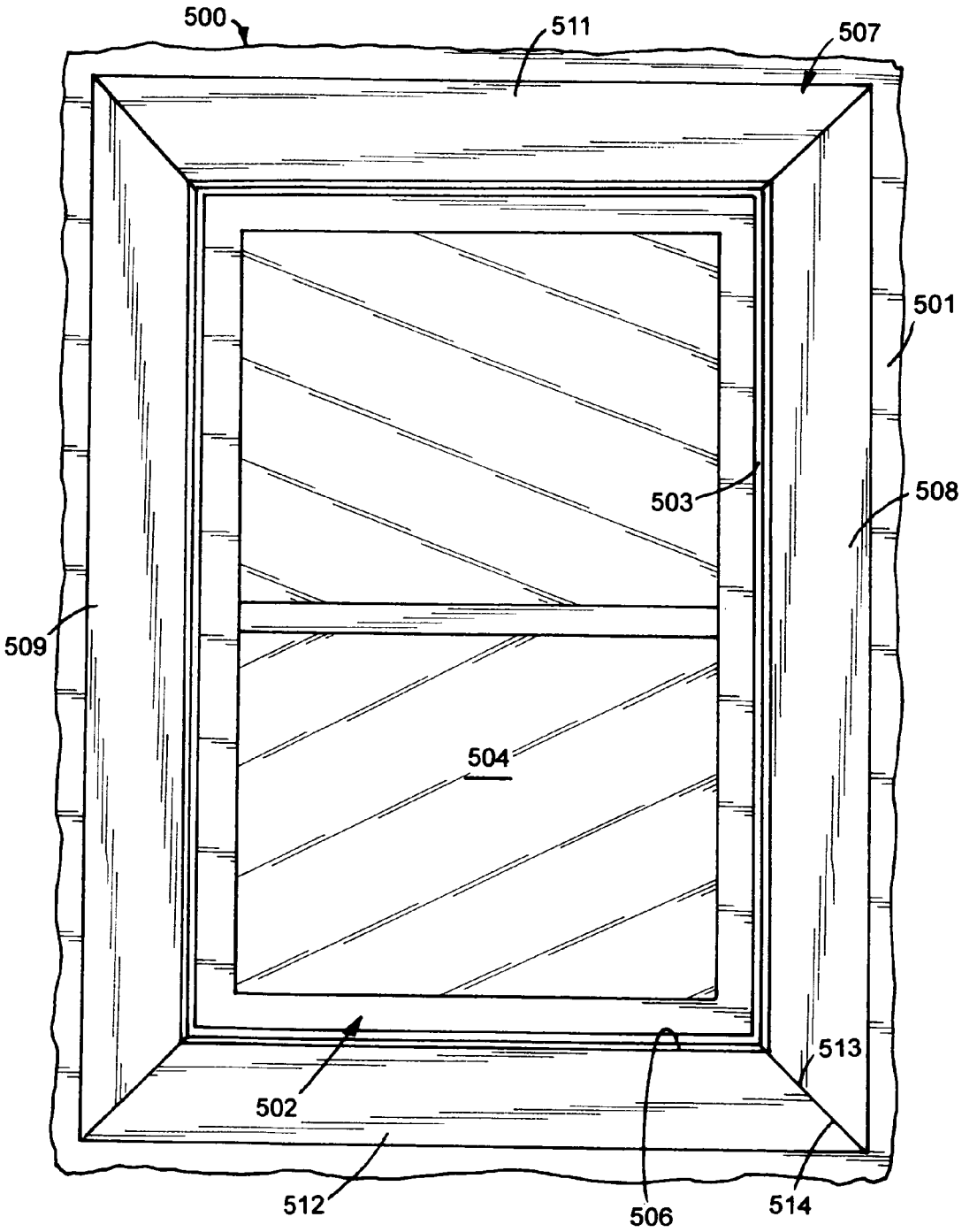
FIG. 30 is a front elevational view of a portion of a building having a window surrounded with a modification of the trim of the invention.
Figure 31:
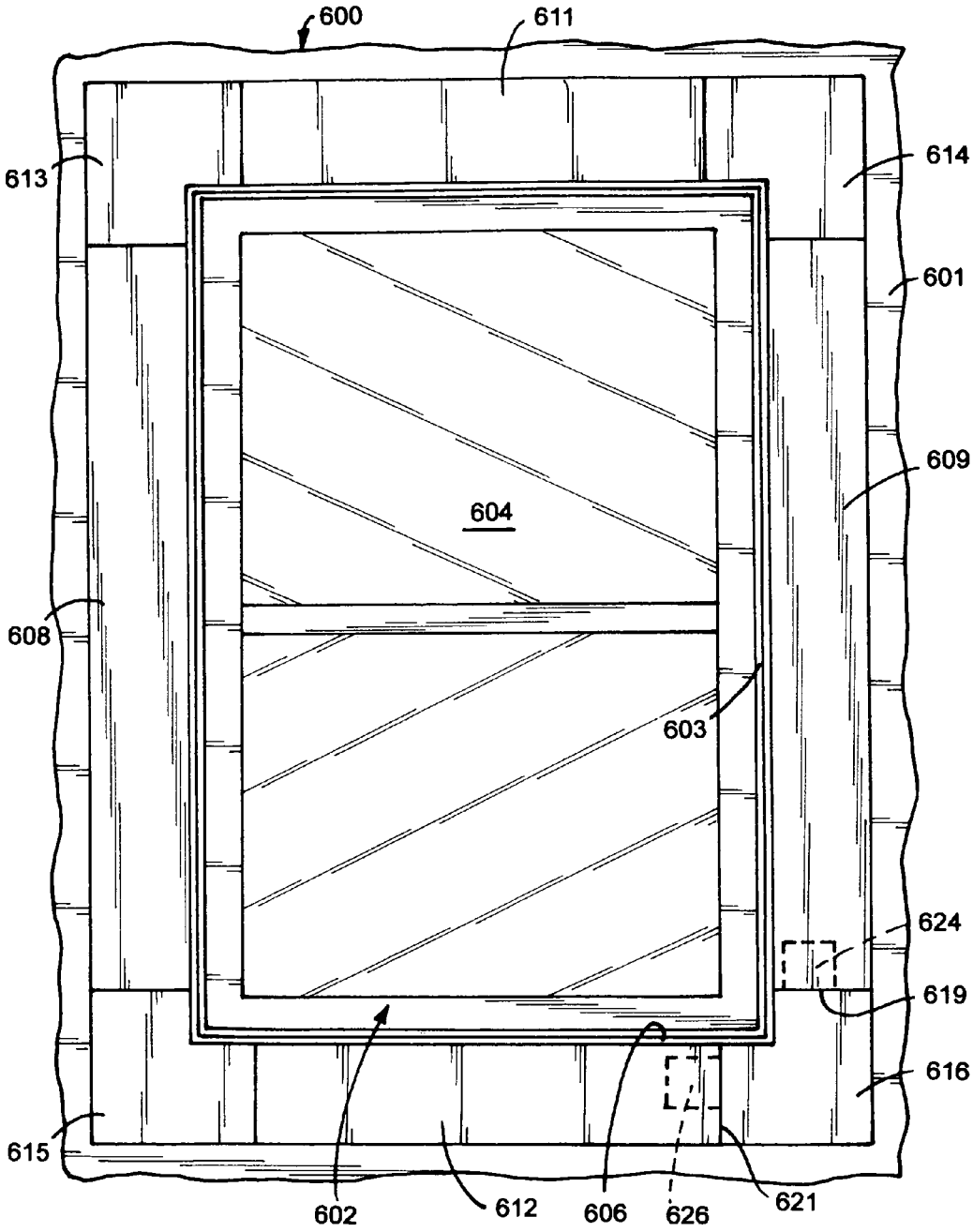
FIG. 31 is a front elevational view of a portion of a building having a window surrounded with another modification of the trim of the invention.

A modification of the trims of FIGS. 1 to 29 secured to the framework of a building wall 500 as shown in FIG. 30. Building wall 500 has outside sheathing or siding 501 and a conventional window assembly 502. Window assembly 502 has a rectangular casing 503 supporting a pair of transparent windows 504. Casing 503 located in an opening 506 in wall 500 is secured to adjacent framework. A trim 507 attached to the framework adjacent opening 506 accommodates portions of siding 501. Trim 507 is also a molding that decorates the border around window assembly 502. Trim 507 comprises side trim members 508 and 509 engageable with top and bottom trim members 511 and 512. The ends of side trim members 508 and 509 adjacent the ends of top and bottom trim members 511 and 512 has mitered or beveled adjacent edges 513 and 514 at each corner of trim 507. The angle of the bevel is 45 degrees. Other bevel angles can be used for the beveled edges of trim members 508, 509, 511 and 512. Trim 507 has primary first members secured to the framework of the building wall. Covers are releasably connected to the first members. Trim 507 can have the structure and functions of trim members 17, 100, 200, 300 and 400, herein incorporated by reference. Trim 507 in use inhibits collateral damage to the building framework and siding when a replacement window assembly or door frame is installed on the building wall.

Another modification of the trims of FIGS. 1 to 29, secured to the framework of a building wall 600 is shown in FIGS. 31 to 34. Building wall 600 has outside sheathing or siding 601 and a conventional window frame assembly 602. Window frame assembly 602 has a rectangular casing 603 accommodating a pair of transparent windows 604. Casing 603 is mounted on framework around an opening 606 in wall 600. A trim 607 attached to the framework around opening 606 accommodates a portion of siding 601. Trim 607 comprises side trim members 608 and 609 and top and bottom trim members 611 and 612. Corner trim members 613, 614, 615 and 616 are connected to the adjacent ends of side trim members 608 and 609 and adjacent ends of top and bottom trim members 611 and 612. Corner trim members 613 to 616 are identical in structure and function. Corner trim member 616 is herein described.

Figure 32:
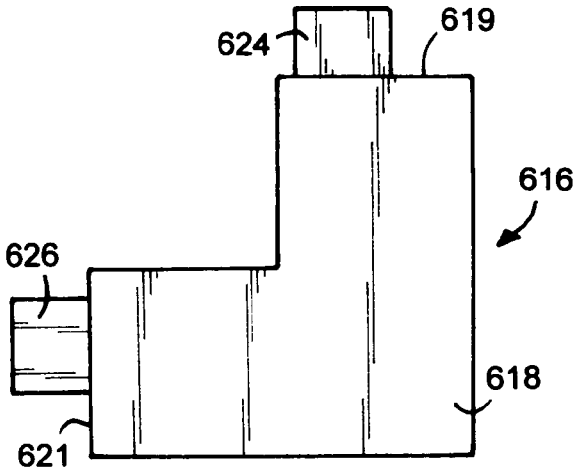
FIG. 32 is a top plan view of an elbow corner member of the trim of FIG. 31.
Figure 33:
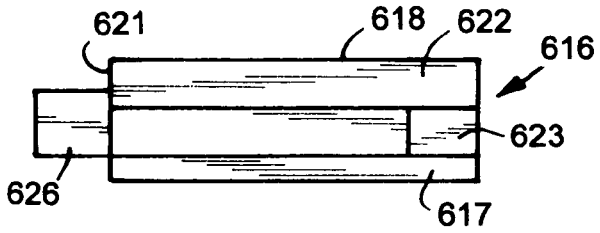
FIG. 33 is a front elevational view of FIG. 32.
Figure 34:
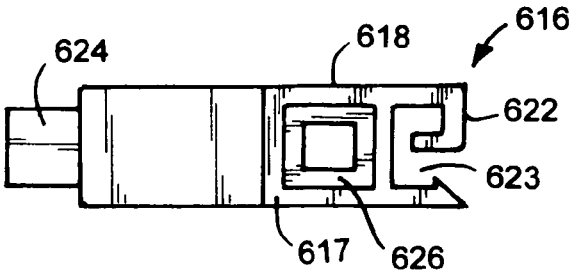
FIG. 34 is a side elevational view of the left side of FIG. 32.

As shown in FIGS. 32 to 34, corner trim member 616 has a bottom or first member 617 adapted to contact the framework of the building wall 600. A top wall 618 having a right angle configuration is joined to first member 617. Corner member 616 has opposite transverse ends 619 and 621 engageable with adjacent ends of trim members 609 and 612. The outside wall 622 of corner member 616 has a right angle pocket 623 for accommodating portions of siding 11. Box shaped members 624 and 626 extend outwardly from ends 619 and 621 into the channels of adjacent side and end members 609 and 612, shown in broken lines in FIG. 31, to retain corner member 616 on side member 609 and bottom member 612.

Prefabricated exterior trim members can be formed from a material such as aluminum, steel, vinyl or polyvinyl chloride (PVC) using extrusion processes. Molten metal or plastic is forced, drawn or extruded through a die for shaping into the exterior trim members 10. The die is usually made from a material such as brass. In order to manufacture the different designs of an exterior trim members for use in the aforementioned different applications, each design is created using a different die in the extrusion process. Alternatively, a single die having additional die plates is used to create the different designs. After extrusion, the extruded exterior trim members continue to a cooling tank section where it is reshaped and cooled in order to harden the trim members. The trim members may then be cut into usable or transportable lengths of the exterior trim members. The details of extrusion, reshaping and cooling are know in the art and are disclosed, for example, in Engineered Materials Handbook, Volume 2, Engineering Plastics, Robert L. Miller, "Thermoplastic Extrusion," pp. 378-88.

As mentioned, exterior trim members are sometimes manufactured with C-channels formed integrally therewith. These C-channels are constructed to accept siding or sheathing attached to the building structure and to partially cover the siding or sheathing. The sheathing or siding is generally constructed from aluminum or vinyl. The C-channels of the trim members are constructed to cover the ends of the siding or sheathing. The C-channels are constructed with sufficient depth to adequately cover the ends of the siding or sheathing during expansion and contraction—resulting from temperature changes. The C-channels also help to exclude water from the siding or sheathing and to cover misalignments of the ends of the sheathing or siding. It has been found that C-channels of approximately 0.9375 wide and approximately 1 inch long is normally sufficient to cover the ends as the sheathing or siding expands or contracts. Hence, the C-channel of a header or a sill is able to cover the bottom or top, respectively, of siding or sheathing that is attached to a building structure.

It should be appreciated that to provide an attractive and securely fastened exterior trim, several independent steps are required. Typically, completion of the trim is done at the job site, beginning with measuring the window openings. The trim members forming the exterior trim may be cut to provide a custom fit or have been pre-cut to fit the dimensions of the window or door frame. Such cutting processes involve setting up work tables and the appropriate saws. Of course, all measuring and cutting must be completed in a precise manner to ensure an exact fit that provides an aesthetically pleasing appearance.

Moreover, after measuring and cutting are complete, the trim members >>e (must then be fastened around the wall opening. For a rectangular window opening, four trim members are first inserted and secured along to the side walls proximate the window opening. In one embodiment, both the window and window frame are already secured to the wall of the building construction prior to installation of the exterior trim members. In a second embodiment, the window and window frame have not been installed and a hole adapted to receive the window and window frame is present for installation of the exterior-trim members followed by installation of the frame and window.

The exterior trim members Ware then nailed or fastened to the wall surfaces 41 surrounding the window, as best depicted in FIGS. 8, 13, 18, 23 and 29. Special care and effort is required when securing these trim members to ensure the structural integrity of the formed joints and to avoid future cracking and splitting that often results from fluctuations in temperature and humidity, as well as the typical shifting and settling of the structure over time.

After installation is complete, the additional step of providing the trim members with a pleasant outward appearance is required. This generally involves covering the trim members with any embodiment of the snap covers or painting or staining to cover the trim members. In addition, a compound to overspread and fill any cracks is also applied to obtain the final desired look. As should be appreciated, the same process is generally used to trim interior walk-through door openings.

As noted, during window replacement, the window frame has to be pulled out for replacement. This means that the siding also has to be at least partially destroyed in order to pull the window frame out. For this invention, the exterior trim will be fastened to the wall with nails, pins and/or studs or other fastening device. A snap cover may also be affixed to the window trim in order to prevent excessive damage by the environment. Next, the window and the siding is inserted and any gaps caulked. During replacement, the snap cover is removed first, any studs or pins pulled out and the exterior trim pulled away from the wall. Since the window is not directly connected to the siding, the siding need not be removed in order to access the window and therefore, destruction of the siding is avoided.

The exterior trim of the present invention may be used on a variety of windows, such as picture windows or small bathroom windows. Doors, such as patio doors, may be single or double width. Hence, in the practice of removing and replacing windows and doors of differing sizes and shapes, the exterior trims of the present invention offers a practical and expedient system and method of replacing windows and doors of varying dimensions and window to accommodate the diverse needs of the craftsman.

As noted, the window trim can be a vinyl frame that can be attached to the siding and allow windows or doors to be easily removed without first having to remove the siding. In other examples, the trim can also be made from aluminum, steel or any other suitable siding material that is used during building construction. Furthermore, the size of the exterior trim can be any dimension so long as the trim is configured to receive any size window, door, siding as needed.

A method of using the exterior trim member during new construction in includes fastening the exterior trim around a window opening prior to installation of window frame assembly and/or any siding. After fastening, the cover is snapped onto the exterior trim followed by insertion of siding and the window frame assembly comprising both frame and window. Alternatively, both siding and the window frame assembly can be inserted into the, exterior trim prior to covering the exterior trim with the cover. After insertion of siding and the window assembly, the wall is caulked as needed to further seal in the exterior trim and fill any gaps or holes in the wall. During replacement, the cover is removed, the exterior trim unfastened and pulled away from the wall leaving behind an accessible window for easy replacement. The window frame assembly is removed and a new exterior trim is fastened to the wall, prior to installation of a new window frame assembly. After lining up the exterior trim with the siding, the new window frame assembly is installed. Any caulking is applied as needed to fill up any gaps.

In addition, while the exterior trim can be used in new construction, the exterior trim can also be used for existing buildings. In this embodiment, any, existing siding is removed or destroyed in order to access and remove the window frame assembly and leave behind a window hole. Next, the exterior trim is applied around the window hole, fastened and the snap cover is snapped onto the exterior trim. New siding is inserted next to the exterior trim on one side while the window frame assembly comprising the frame and window is installed to complete installation of a new window system. During subsequent replacement of windows, the exterior trim that prevents direct attachment of the window to the siding can be easily removed after the snap cover is removed, followed by easy removal of the window assembly. Thereafter, a new exterior trim is applied followed by replacement of the window assembly to complete installation of a new window assembly. It is contemplated that this process is repeated as many times as is necessary during improvement of a building construction when removal or installation of doors or windows is undertaken.

Several embodiments of the trim accommodating siding of a building and window and door structures have been shown and described. Changes in structures, materials and arrangement of the trims ban be made by persons skill in the art according to the Trims herein described.

We claim:

1. A trim for a building having framework surrounding an opening for a window assembly or a door frame and siding located on the framework, said siding having end portions, comprising:

a member having a back wall, first and second side walls joined to the back wall, and a channel between said first and second side walls, a first flange joined to the back wall, a second flange joined to the second side wall and extending generally parallel to the first flange, at least one projection on the first side wall for spacing a window assembly or door frame from the first side wall to accommodate caulking to seal the window assembly or door frame with the first side wall of the member, at least one fastener for attaching the back wall to the framework surrounding the opening, a cover mounted on the member extending over the channel between said first and second side walls, said cover having a lip cooperating with the second flange to hold the cover on the second flange, said lip being spaced from the first flange providing a lateral side pocket between the lip and first flange for accommodating the end portions of the siding, an end wall joined to the lip extending into the pocket toward the siding located in the pocket, and a releasable connector on the cover and first side wall holding the cover on the first side wall whereby the cover is retained on the member by the lip and releasable connector.

2. The trim of claim 1 including:

at least one longitudinal groove in the end wall adapted to be used to remove a portion of the end wall to accommodate the thickness of the siding.

3. The trim of claim 2 wherein:

the end wall has a plurality of longitudinal grooves.

4. The trim of claim 1 including:

a plurality of projections on the first side wall for spacing a window or door frame from the first wall.

5. The trim of claim 1 wherein:

the back wall has a plurality of apertures, and a plurality of fasteners extended through said apertures to attach the back wall to the framework of the building.

6. The trim of claim 1 wherein:

the releasable connector comprises, an inside wall joined to the first side wall providing a groove between the first side wall and the inside wall, said cover having a rib and at least one bead on the rib extending into the groove to releasably hold the cover on the first side wall.

7. A trim for a building having framework surrounding an opening for a window assembly or a door frame and siding on the framework, said siding having end portions, comprising:

a trim member having a back wall, first and second side walls joined to the back wall, a channel between the first and second side walls, a first flange joined to the back wall, a second flange joined to the second side wall and extending generally parallel to the first flange, at least one fastener for attaching the back wall to the framework surrounding the opening in the building, a cover mounted on the member extending over the channel between the first and second side walls, said cover having a lip cooperating with the second flange to hold the cover on the second flange, an end wall joined to the lip extending toward the first flange and spaced from the first flange providing a lateral side pocket between the first flange and end wall for accommodating the end portions of the siding, and a releasable connector on the cover and first side wall holding the cover on the first side wall whereby the cover is retained on the member by the lip and releasable connector.

8. The trim of claim 7 including:

at least one groove in the end wall adapted to be used to remove a portion of the end wall to accommodate the thickness of the end portions of the siding.

9. The trim of claim 8 wherein:

the end wall has a plurality of longitudinal grooves.

10. The trim of claim 7 wherein:

at least one projection on the first side wall for spacing a window assembly or door frame from the first side wall to accommodate caulking to seal the window assembly or door frame with the first side wall of the member.

11. The trim of claim 7 wherein:

the releasable connector comprises an inside wall joined to the first side wall providing a groove between the first side wall and inside wall, said cover having a rib and at least one bead on the rib extending into the groove to releasably hold the cover on the first side wall.

12. The trim of claim 7 including:

a plurality of projections on the first side wall for spacing a window assembly or door frame from the first side wall.

13. In combination a building having framework surrounding an opening for a window assembly or a door, and siding having end portions located adjacent the framework surrounding the opening, a trim located on the framework adjacent the opening and end portions of the siding, said trim including a member having a back wall, first and second side walls joined to the back wall, and a channel between said first and second side walls, a first flange joined to the back wall, a second flange joined to the second side wall and extending generally parallel with the first flange, at least one fastener attaching the back wall to the framework adjacent the opening and end portions of the siding, a cover mounted on the member extended over the channel between said first and second side walls, said cover having a lip cooperating with the second flange to hold the cover on the second flange, said lip being spaced from the first flange providing a lateral side pocket between the lip and first flange, said end portions of the siding extending into the lateral side pocket between the lip and first flange, and a releasable connector holding the cover on the first side wall whereby the cover is retained on the member by the lip and releasable connector.

14. The combination of claim 13 including:

at least one projection on the first side wall for spacing a window assembly or door frame from the first wall to accommodate caulking to seal the window assembly or door frame with the first side wall.

15. The combination of claim 13 including:

a plurality of projections on the first side wall for spacing the window assembly or door frame from the first wall to accommodate caulking to seal the window assembly or door frame with the first side wall.

16. The combination of claim 13 wherein:

the releasable connector comprises an inside wall joined to the first side wall providing a groove between the first side wall and the inside wall, said cover having a rib and at least one bead on the rib extending into the groove to releasably hold the cover on the first side wall.

17. In combination a building having framework surrounding an opening for a window assembly or a door, and siding having end portions located adjacent the framework surrounding the opening, a trim located on the framework adjacent the opening and end portions of the siding, said trim including a member having a back wall, first and second side walls joined to the back wall, and a channel between said first and second side walls, a first flange joined to the back wall, a second flange joined to the second side wall and extending generally parallel with the first flange, at least one fastener attaching the back wall to the framework adjacent the opening and end portions of the siding, a cover mounted on the member extended over the channel between said first and second side walls, said cover having a lip cooperating with the second flange to hold the cover on the second flange, an end wall joined to the lip extending toward the first flange and spaced from the first flange providing a lateral side pocket between the end wall and first flange, said end portions of the siding extending into the lateral side pocket between the end wall and first flange, and a releasable connector holding the cover on the first side wall whereby the cover is retained on the member by the lip and releasable connector.

18. The combination of claim 17 including:

at least one projection on the first side wall for spacing a window assembly or door frame from the first wall to accommodate caulking to seal the window assembly or door frame with the first side wall.

19. The combination of claim 17 including:

a plurality of projections on the first side wall for spacing the window assembly or door frame from the first wall to accommodate caulking to seal the window assembly or door frame with the first side wall.

20. The combination of claim 17 wherein:

the releasable connector comprises an inside wall joined to the first side wall providing a groove between the first side wall and the inside wall, said cover having a rib and at least one bead on the rib extending into the groove to releasably hold the cover on the first side wall.

21. The combination of claim 17 including:

at least one groove in the end wall adapted to be used to remove a portion of the end wall to accommodate the thickness of the siding.

22. The combination of claim 21 wherein:

the end wall has a plurality of grooves.

* * * * *